United States Patent [19]

Hamada

[11] Patent Number: 4,798,027

[45] Date of Patent: Jan. 17, 1989

[54] METHOD OF AND APPARATUS FOR SANDBLASTING WORKPIECE

[75] Inventor: Shuji Hamada, Yokohama, Japan

[73] Assignee: Niigata Engineering Co., Ltd., Tokyo, Japan

[21] Appl. No.: 91,879

[22] Filed: Sep. 1, 1987

[51] Int. Cl.[4] ..... E06B 07/20

[52] U.S. Cl. ..... 51/310; 51/410; 51/418

[58] Field of Search ..... 51/410, 417, 418, 421, 51/426, 310, 312; 118/301

[56] References Cited

U.S. PATENT DOCUMENTS

| | | | |
|---|---|---|---|
| 767,362 | 8/1904 | Phillips | 51/310 |
| 2,034,308 | 3/1936 | Morgan | 51/426 |
| 3,921,336 | 11/1975 | Nishio | 51/310 |
| 4,530,861 | 7/1985 | Sippel | 51/310 |

*Primary Examiner*—Frederick R. Schmidt
*Assistant Examiner*—Blynn Shideler
*Attorney, Agent, or Firm*—Oblon, Fisher, Spivak, McClelland & Maier

[57] ABSTRACT

There are provided a sandblasting apparatus and a method for processing a workpiece which has a first surface to be processed adjacent to a second surface not to be processed. The apparatus includes a masking device for masking the second surface and an abrasive blowing device for causing abrasive grains to impinge against the workpiece to process the first surface. The masking device includes a masking tape, an intermittent tape traveling device for causing the masking tape to travel to index a portion of the masking tape in the vicinity of the workpiece intermittently, and an urging device for bringing the portion of the masking tape into contact with the second surface of the workpiece to cover the same.

16 Claims, 7 Drawing Sheets

METHOD OF AND APPARATUS FOR SANDBLASTING WORKPIECE

BACKGROUND OF THE INVENTION

1. Field of the Invention

The present invention pertains to a method of and its apparatus for sandblasting a workpiece which has a surface not to be sandblasted adjacent to a surface to be sandblasted.

2. Prior Art

A chamfering of an end edge Wa of a relatively small workpiece W, such as one shown in FIG. 1, and a peripheral edge Wc of a bore Wb therein, has conventionally been performed by a hand process, utilizing an abrasive tape or the like. However, such method has disadvantages that it is troublesome, time-consuming and inefficient.

As an automated method of such a processing, a sandblasting method may be effected in which abrasive grains comprised of silica sand, alumina, chilled cast iron or the like are caused to strongly impinge against a surface of a workpiece to be processed. However, if the workpiece W has, as shown in FIG. 1, surfaces $f_2$ requiring a mirror finish adjacent to surfaces $f_1$ to be processed by the sandblasting, there would be a fear that the abrasive grains impinge also against the surfaces $f_2$ to exert a bad influence thereupon.

SUMMARY OF THE INVENTION

It is therefore an object of the present invention to provide a sandblasting method which can be conducted even for processing a workpiece which has a surface not to be sandblasted adjacent to a surface to be sandblasted.

Another object of the present invention is to provide an apparatus utilizing such sandblasting method.

According to a first aspect of the present invention, there is provided a method of sandblasting a workpiece having a first surface to be processed and a second surface not to be processed, comprising the steps of providing a sandblasting apparatus comprising masking means including a masking tape, intermittent tape traveling means operable to cause the masking tape to travel by a prescribed length to index a portion of the masking tape in the vicinity of the workpiece intermittently, and urging means operable to urge the portion of the masking tape into contact with the second surface of the workpiece to cover the same, and abrasive grain blowing means for blowing the abrasive grains against the workpiece to process the first surface of the workpiece; operating the masking means to bring the portion of the masking tape into contact with the second surface of the workpiece to cover the same; subsequently operating the abrasive grain blowing means to blow the abrasive grains against the workpiece to process the first surface of the workpiece; subsequently stopping the abrasive grain blowing means to cease blowing the abrasive grains against the workpiece; and subsequently operating the masking means to release the masking tape from the workpiece.

According to a second aspect of the present invention, there is provided a sandblasting apparatus for processing a workpiece by causing abrasive grains to impinge against the workpiece, the workpiece having a first surface to be processed and a second surface not to be processed, comprising masking means including a masking tape, intermittent tape traveling means operable to cause the masking tape to travel by a prescribed length to index a portion of the masking tape in the vicinity of the workpiece intermittently, and urging means operable to urge the portion of the masking tape into contact with the second surface of the workpiece to cover the same, and abrasive grain blowing means for blowing the abrasive grains against the workpiece to process the first surface of the workpiece.

DESCRIPTION OF THE PREFERRED EMBODIMENTS OF THE INVENTION

Figure 1:
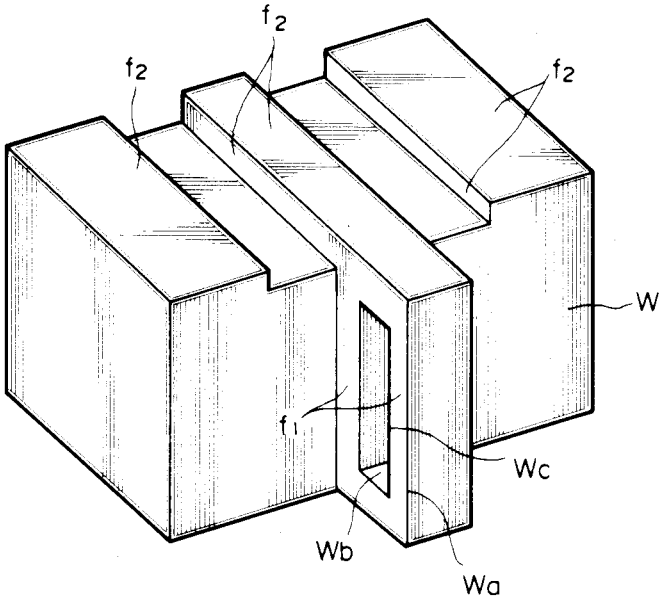
FIG. 1 is a perspective view showing an example of a workpiece.
Figure 2:
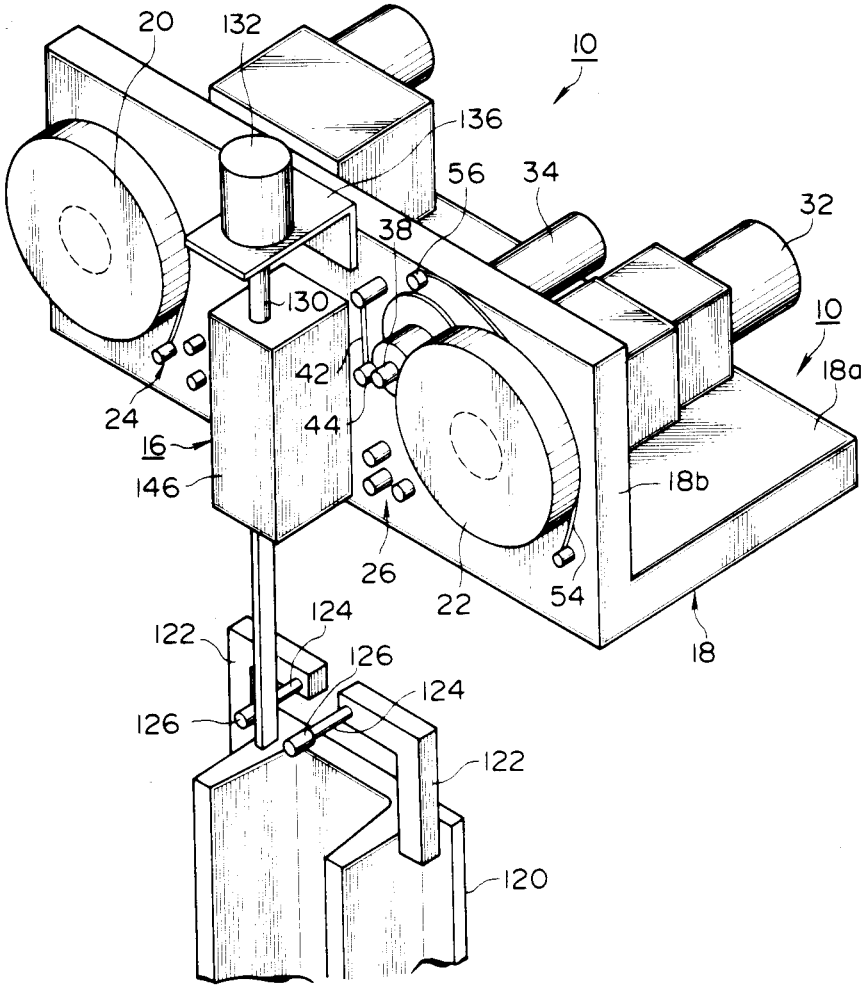
FIG. 2 is a schematic perspective view of a sandblasting apparatus in accordance with the present invention.
Figure 3:
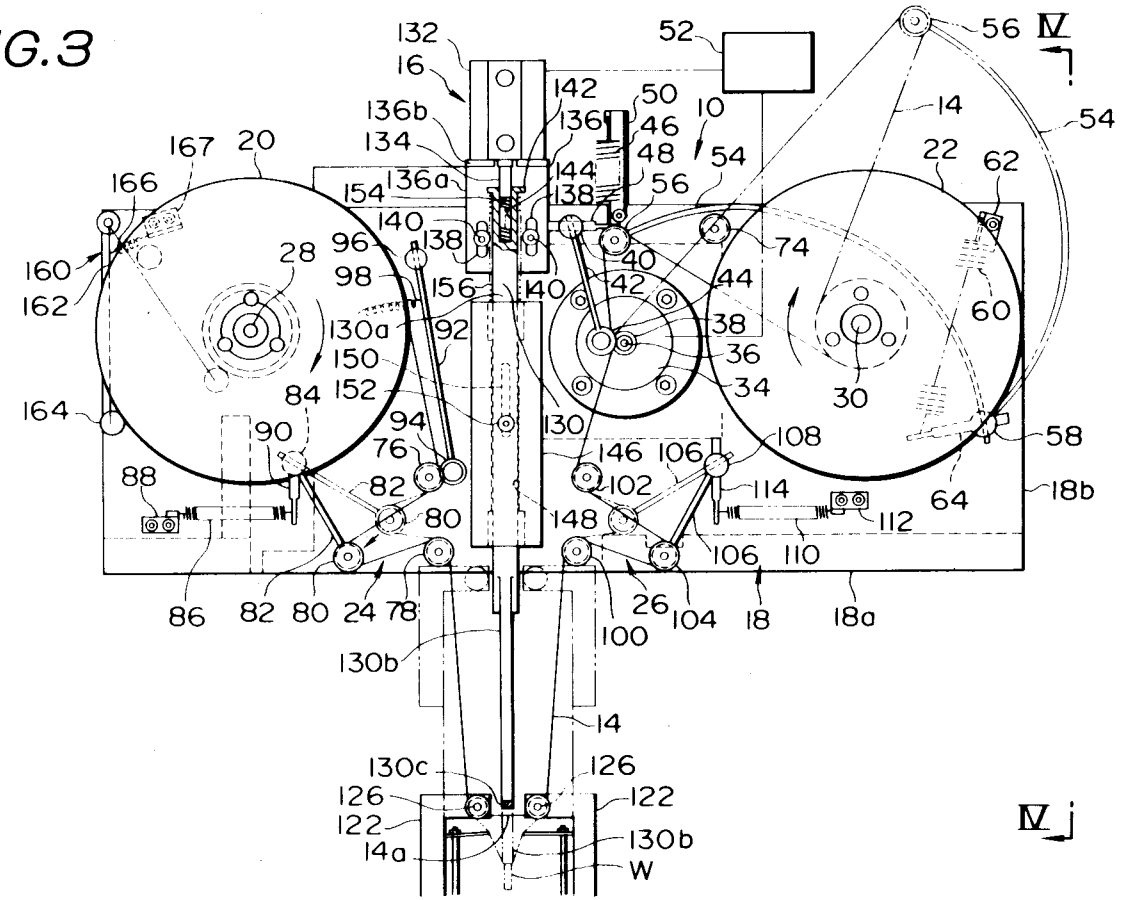
FIG. 3 is a front elevational view of the apparatus of FIG. 2.
Figure 4:
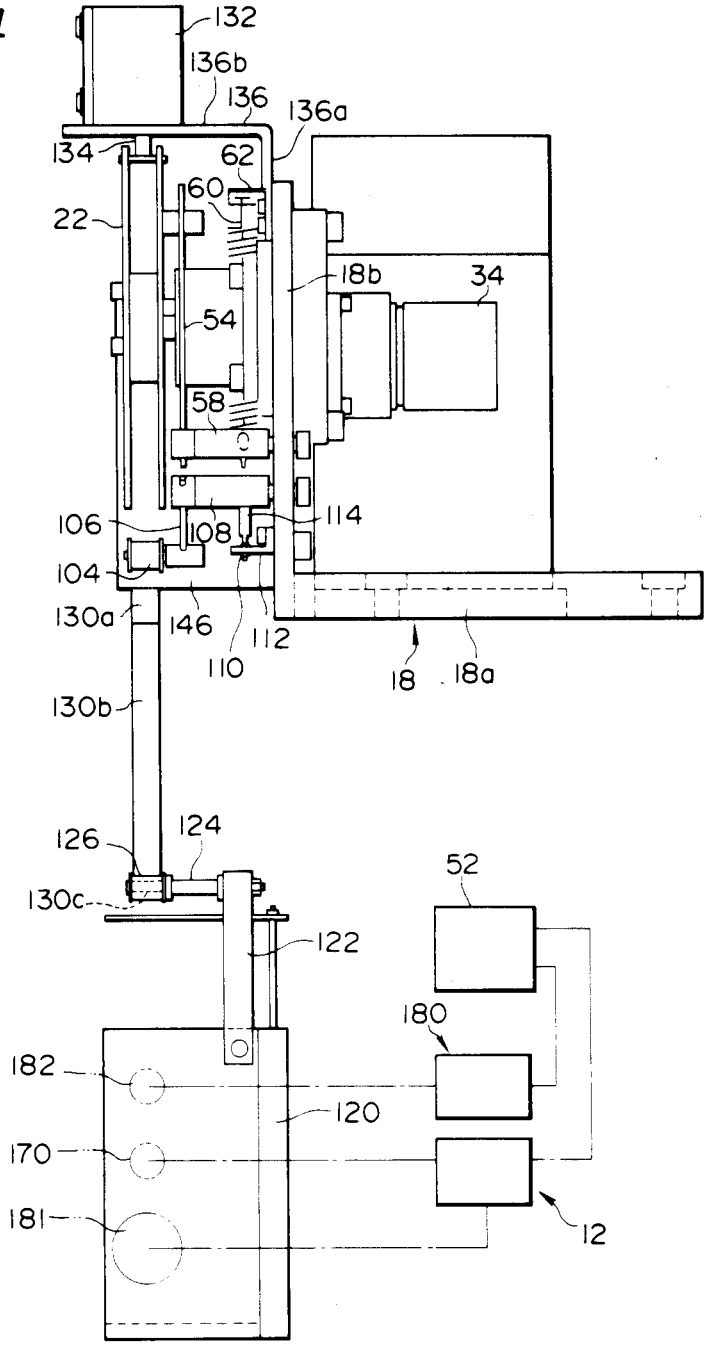
FIG. 4 is a side elevational view of the apparatus of FIG. 2 as seen in the direction indicated by the arrows IV—IV of FIG. 3.

Referring to FIGS. 2 to 4, there is illustrated one embodiment of a sandblasting apparatus in accordance with the present invention, which is suitably utilized for processing the workpiece W shown in FIG. 1, the workpiece having the first surface $f_1$ to be processed and the second surfaces $f_2$ not to be processed adjacent thereto.

The sandblasting apparatus comprises a masking device 10 and an abrasive grain blowing device 12. The masking device 10 includes an intermittent tape traveling device operable to cause a masking tape 14 to travel to dispose or index a portion **14*a* of the tape of a prescribed length in the vicinity of the workpiece W, and an urging device 16 operable to urge the indexed portion 14*a* of the masking tape 14 into contact with the second surfaces of the workpiece W to cover the same. The masking tape 14** may be made of resilient material such as sponge and rubber, and may have tension strength ranging from 0.1 to 6.0 kg/cm$^2$, preferably from 0.4 to 5.0 kg/cm$^2$, and elongation percentage ranging from 0 to 600%, preferably from 200 to 400%.

The intermittent tape traveling device includes a first base 18 having a horizontal base plate **18*a* and a back plate 18*b* perpendicular to the base plate 18*a*, a feed reel 20 having the masking tape 14 wound therearound, a take-up reel 22 for winding the masking tape therearound, an intermittent winding mechanism operable to intermittently wind the masking tape 14 from the feed reel 20 on the take-up reel 22, and first and second tension control mechanisms 24 and 26 for regulating the tension of the masking tape 14** appropriately.

The feed reel 20 is rotatably mounted on a left-hand side of a front face of the back plate **18*b* through a shaft 28 disposed perpendicular to the back plate while the take-up reel 22 is rotatably mounted on a right-hand side of the front face of the back plate 18*b* through a shaft 30 disposed perpendicular to the back plate and extending therethrough. A winding electric motor 32, which is mounted on a back face of the back plate 18*b*, is connected to the shaft 30 for driving the take-up reel 22. A motor 34 is mounted on the back plate and disposed between the feed and take-up reels in such a manner that an output shaft 36 thereof extends forwardly, and a pinch roller 38 is fixedly secured to the output shaft 36. In addition, a columnar member 40 is rotatably mounted on the front face of the back plate 18*b* adjacent to the motor 34, and a pivoting arm 42 carrying a pressing roller 44 at its one end is fixedly secured at the other end to the columnar member 40. A tension coil spring 46, which has one end connected to the columnar member 40 through a connecting member 48 and the opposite end to a bracket 50 mounted on the front face of the back plate 18*b*, is provided for biasing the columnar member 40 to rotate counterclockwise to pivot the arm 42 about the columnar member 40 counterclockwise (FIG. 3), to thereby urge the pressing roller 44 toward the pinch roller 38. The motor 34 is responsive to a drive signal produced by a conventional control device 52 such as a microcomputer, and is operable to cooperate with the pressing roller 44 to draw the masking tape 14 by a prescribed length to index a new portion 14*a*** thereof in the vicinity of the workpiece W.

Figure 5:
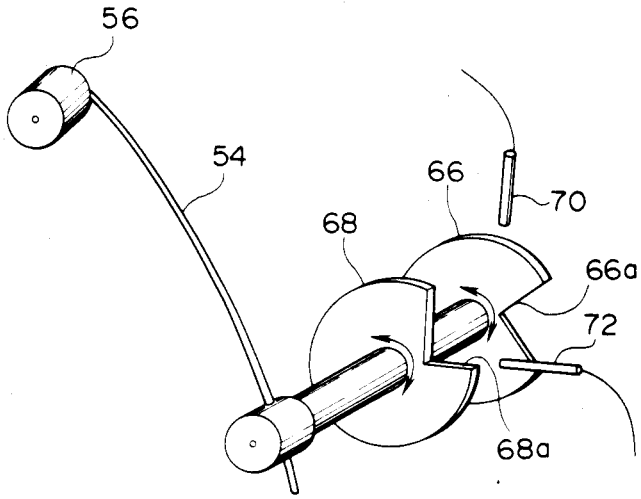
FIG. 5 is a schematic perspective view showing limit means mounted on the apparatus of FIG. 2.
Figure 6:
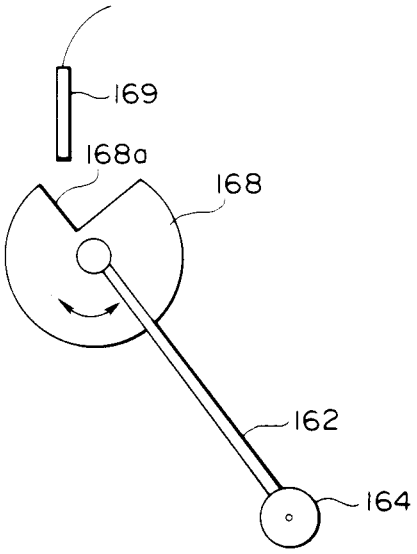
FIG. 6 is a schematic view showing tape detecting means mounted on the apparatus of FIG. 2.
Figure 7:
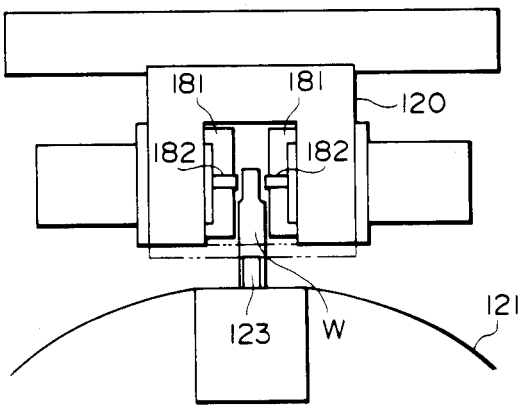
FIG. 7 is a plan view of a part of the apparatus of FIG. 2.

An arcuate pivoting arm 54, which carries a guide roller 56 at its one end, is also disposed on the right-hand side of the front face of the back plate **18*b*, and the opposite end of the arcuate arm 54 is fixedly secured to a columnar member 58 rotatably mounted on the front face of the back plate 18*b*. A tension coil spring 60, which has one end fixedly secured to a bracket 62 mounted on the front face of the back plate 18*b* and the other end to the columnar member 58 through a connecting member 64, is provided for urging the columnar member 58 to rotate clockwise to pivot the arcuate arm 54 about the columnar member 58 clockwise, as shown by a two-dot chain line in FIG. 3, to thereby pull the masking tape 14 in a prescribed winding direction. First and second dog members 66 and 68, each of which consists of a disk having a cut-out 66*a*, 68*a*, as shown in FIG. 5, are fixedly secured to the columnar member 58 in such a manner that the cut-out 66*a* of the first dog member 66 and the cut-out 68*a* of the second dog member 68 are circumferentially displaced from each other by a prescribed angle. First and second limit switches 70 and 72, each of which is comprised of a photo-sensor or the like and connected to the control device 52 are disposed adjacent to the first and second dog members 66 and 68, respectively. The first limit switch 70 is provided for sensing the cut-out 66*a* of the first dog member 66 when the arcuate pivoting arm 54 is pivoted to a position as shown by a two-dot and chain line in FIG. 3, to produce a start signal to drive the winding motor 32 to wind the masking tape 14 on the take-up reel 22. On the other hand, the second limit switch 72 is provided for sensing the cut-out 68*a* of the second dog member 68 when the arcuate pivoting arm 54 is pivoted to a position as shown by a solid line in FIG. 3, to produce a stop signal to stop the winding motor 32. Thus, the winding motor 32, the pinch roller 38, the motor 34, the pressing roller 44, the arcuate pivoting arm 54, the limit switches 70 and 72 and so on cooperate with one another to constitute the intermittent winding mechanism mentioned above. Further, a stopper roller 74 is mounted on the front face of the back plate 18*b* for preventing the arcuate pivoting arm 54** from being pivoted counterclockwise excessively.

The first tension control mechanism 24, which is disposed on the left-hand side of the front face of the back plate **18*b*, includes a pair of upper and lower guide rollers 76 and 78 rotatably mounted on the back plate 18*b* and spaced vertically from each other and a intermediate guide roller 80 spaced from the upper and lower guide rollers 76 and 78 to the left (FIG. 3), and the masking tape 14 is to be guided by the guide rollers in the order of the upper roller 76, the intermediate roller 80 and the lower roller 78. The intermediate roller 80 is rotatably mounted on one end of a pivoting arm 82, which is secured at the other end to a columnar member 84 rotatably mounted on the front face of the back plate 18*b*, and a tension coil spring 86 having one end fixedly secured to the back plate 18*b* through a bracket 88 is secured to the columnar member 84 through a connecting member 90 for urging the columnar member 84 to rotate clockwise to pivot the pivoting arm 82 about the columnar member 84 clockwise, as shown by a solid line in FIG. 3, to thereby adjust the tension of the masking tape 14. A pivoting arm 92, which carries an urging roller 94 at its one end and is secured at its other end to a columnar member 96 rotatably mounted on the front face of the back plate 18*b*, is disposed adjacent to the feed reel 20, and a tension coil spring 98 is connected between the back plate 18*b* and the pivoting arm 92 for biasing the pivoting arm 92 to pivot clockwise (FIG. 3) about the columnar member 96, to urge the urging roller 94 toward the upper guide roller 76 to thereby prevent the masking tape 14** from slackening.

The second tension control mechanism 26, which is disposed on the right-hand side of the front face of the back plate **18*b*, is basically similar in construction to the first tension mechanism 24. Specifically, the mechanism includes a pair of lower and upper guide rollers 100 and 102 and an intermediate guide roller 104 spaced from the lower and upper rollers 100 and 102 to the right (FIG. 3), and the masking tape 14 is to be guided by the guide rollers in the order of the lower roller 100, the intermediate roller 104 and the upper roller 102. The intermediate roller 104 is rotatably mounted on one end of a pivoting arm 106, which is secured at the other end to a columnar member 108 rotatably mounted on the back plate 18*b*, and a tension coil spring 110 having one end fixedly secured to the back plate 18*b* through a bracket 112 is secured to the columnar member 108 through a connecting member 114 for urging the columnar member 108 to rotate counterclockwise to pivot the pivoting arm 106 counterclockwise about the columnar member 108, as shown by a solid line in FIG. 3, to thereby adjust the tension of the masking tape 14**.

Further, a second base 120, which has a pair of brackets 122 mounted thereon and spaced right and left (FIG. 3), is disposed under the first base 18 for sliding vertical movement, and a pair of rods 124 carrying guide rollers 126 at their foremost ends, respectively, are secured at their rearmost ends to the brackets 122, respectively. The masking tape 14 fed through the first tension control mechanism 24 from the feed reel 20 is guided by the rollers 126 in the order of the left roller and the right roller (FIG. 3), and the aforementioned portion 14a of the masking tape 14 is indexed between the guide rollers 126. A turn table 121 is disposed adjacent to the second base 120, and a plurality of holders 123 (only one of which is shown) are disposed on the periphery of the turn table 121 circumferentially equally spaced relation to one another. A plurality of workpieces W are detachably mounted on the holders 123, respectively, and by the operation of the turn table, the workpieces W are indexed orderly in a prescribed position under the guide rollers 126.

The urging device 16, which is disposed between the feed and take-up reels 20 and 22, includes an urging rod 130 extending vertically and having an upper portion 130a of a circular cross section and a lower portion 130b of a rectangular cross section, and an actuator in the form of a pneumatic cylinder 132 having a piston rod 134 extending downwardly. The urging rod 130 includes an urging member 130c attached to the lower end of the lower portion 130b. The pneumatic cylinder 132, which is connected to a pneumatic circuit including a speed control valve, is responsive to a drive signal produced by the aforementioned control device 52, and is operable to move the rod 130 axially thereof to cause the urging member 130c of the urging rod 130 to urge the indexed portion 14a of the masking tape 14 onto the second surfaces of the workpiece W. The pneumatic cylinder 132 is fixedly mounted on a L-shaped bracket 136 which includes a vertical part 136a and a horizontal part 136b, and is mounted on an upper portion of the front face of the back plate 18b of the first base 18. The bracket 136 includes a pair of elongated apertures 138 formed in the vertical part thereof and extending vertically, and is secured to the back plate 18b through a pair of fastening bolts 140 threaded into the back plate 18b, so that the vertical position of the bracket 136 is adjustable. The upper portion 130a of the rod 130 has a flange portion 142 formed at its upper end and a bore 144 formed in an upper end face and extending axially thereof, and the lower end portion of the piston rod 134 of the pneumatic cylinder 132 is inserted in the bore 144 for sliding movement longitudinally of the rod 130. Fixedly secured to the back plate 18b of the first base 18 is a guide housing 146 of a rectangular cross section having a through hole 148 of a circular cross section extending longitudinally thereof, and the upper portion 130a of the urging rod 130 is slidably housed in the through hole 148. The urging rod 130 includes an elongated groove 150 formed therein and extending longitudinally thereof, and a key member in the form of a bolt 152 is threaded into a front face of the guide housing 146 so as to protrude into the elongated groove 150 for preventing the urging rod 130 from rotating circumferentially thereof. A first compression coil spring 154 is housed in the bore 144 of the rod 130 so as to act between the piston rod 134 and the urging rod 130 to urge the urging rod 130 downwardly, and a second compression coil spring 156 is disposed around the urging rod 130 so as to act between the flange portion 142 of the urging rod 130 and the guide housing 146 to urge the urging rod 130 upwardly, the guide housing 146 serving as stopper means for the second spring 156.

The masking device 10 further includes tape detecting means 160 for detecting a remaining amount of the masking tape 14 wound on the feed reel 20. The detecting means 160 comprises a pivoting arm 162 mounted on the front face of the back plate 18b for pivotal movement about one end thereof, a roller 164 mounted on the other end of the arm 162, a tension coil spring 166 having one end connected to the arm 162 and the other end connected to a bracket 167 mounted on the back plate 18b for urging the other end of the pivoting arm 162 radially inwardly of the feed reel 20 to bring the roller 164 into contact with the masking tape 14 wound on the feed reel 20, a disk-shaped dog member 168 having a cut-out 168a and disposed on the one end of the arm, and a limit switch in the form of a photo-sensor 169 disposed adjacent to the dog member 168 for sensing the cut-out 168a of the dog member 168 when the arm 162 is pivoted as shown by a two-dot and chain line in FIG. 3, i.e., when the remaining amount of the masking tape 14 wound on the feed reel 20 reduces to almost zero, to send a signal for stopping all the devices to the control device 52.

Figure 8:
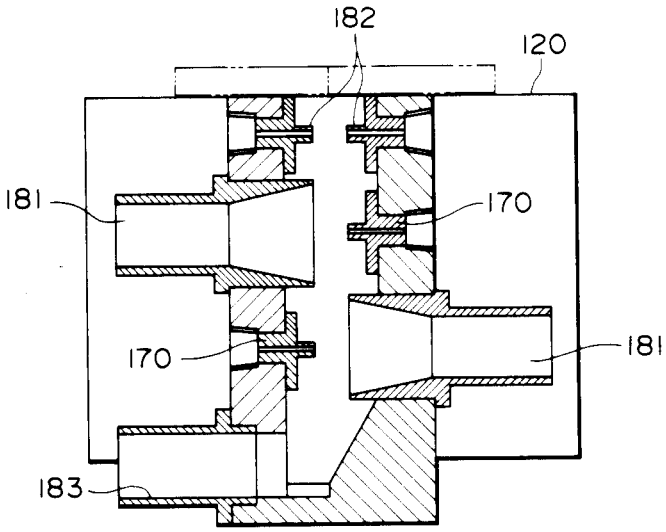
FIG. 8 is a cross-sectional of the part of FIG. 7.

The abrasive grain blowing device 12 includes nozzles 170 attached to the slidable second base 120 for strongly blasting abrasive grains against the workpiece W, which is held by the holder 123 and disposed under the guide rollers 126. The nozzles 170 are connected to a tank through pipes, and the abrasive grains are conventionally delivered from the tank by compressed air provided by an operation of an air compressor. A cleaning device 180 is disposed adjacent to the abrasive grain blowing device 12. The cleaning device 180 includes a pair of nozzles 182 connected to the air compressor for blowing a compressive air against the workpiece W to remove the abrasive grains and dust adhered thereto. In addition to the masking device 10, the abrasive grain blowing device 12 and the cleaning device 180 are connected to and controlled successively by the control device 52. Further, the nozzles 170 of the abrasive grain blowing device 12 and the nozzles 182 of the cleaning device 180 are all attached to the slidable base 120, as shown in FIG. 8, and by the sliding vertical movement of the base 120, the nozzles are moved to suitable positions, respectively. In FIG. 8, 181 denotes a first suction nozzle for drawing the abrasive grains caused to impinge against the workpiece W thereinto by suction, and 183 denotes a second suction nozzle for drawing the air blown against the workpiece W thereinto by suction.

For sandblasting the workpiece W by the above apparatus, the workpiece W is loaded on the holder and disposed in position, and then the control device 52 is first actuated to operate the masking device 10. In the beginning, the masking device 10 is in such a position as shown by a solid line in FIG. 3, and then the pneumatic cylinder 132 is energized by the control device 52 to move the urging rod 130 downwardly to urge the masking tape 14 downwardly into contact with the second surfaces of the workpiece W, as shown in a two-dot and chain line in FIG. 3. In this case, the first spring 154 acts between the piston rod 134 of the pneumatic cylinder 132 and the urging rod 130 to urge the urging rod 130 downwardly while the second spring 156 acts between the flange 142 of the urging rod 130 and the guide housing 146 to urge the urging rod 130 upwardly, and therefore the urging rod 130 is urged toward the workpiece W at an optimal biasing pressure under the influence of the two springs. In addition, the tension of the masking tape 14 is maintained constantly by means of the two tension control mechanisms 24 and 26. Specifically, when the masking tape 14 is urged by the urging rod 130 into contact with the workpiece W, each intermediate roller 80, 104 is caused to move to such a position as shown by a two-dot and chain line in FIG. 3 against the biasing force of each spring 86, 110, to thereby maintain the tension of the masking tape 14 appropriately.

Thereafter, the abrasive grain blowing device 12 is actuated by the control device 52 to impinge the abrasive grains from the nozzle 170 against the workpiece W to process the surfaces thereof. In this case, since the second surfaces of the workpiece W are covered with the masking tape 14, the abrasive grains injected from the nozzle 170 are prevented from being brought into contact with the second surfaces, so that only the first surfaces thereof are subjected to sandblasting.

When the sandblasting of the workpiece W has been completed in this manner, the abrasive grain blowing device 12 is stopped, and then the cleaning device 180 is actuated by the control device 52 to blow the compressive air against the workpiece W to remove abrasive grains, dust and so on attached thereto. Subsequently, the masking device 12 is again operated by the control device 52 to activate the pneumatic cylinder 132 to cause the urging rod 130 to move upwardly to thereby release the masking tape 14 from the workpiece W. In this case, since the urging pressure exerted on the masking tape 14 is released, the springs 86 and 110 of the tension control mechanisms 24 and 26 exert pivoting forces on the pivoting arms 82 and 106, respectively, to pivot the arms to such positions as shown by solid lines in FIG. 3, respectively. Subsequently, the motor 34 is actuated by the control device 52 to rotate the pinch roller 38 clockwise (FIG. 3) by a prescribed number of revolutions to cause the pinch roller 38 to cooperate with the pressing roller 44 to draw the masking tape 14 upwardly, so that the masking tape 14 is caused to travel and a new portion 14*a* thereof is indexed in the prescribed position in the vicinity of the workpiece. Thereupon, under the influence of the spring 60, the arcuate pivoting arm 54 is caused to pivot clockwise (FIG. 3) about the columnar member 58 to guide that portion of the masking tape 14 wound up by the pinch roller 38 as shown in a two-dot and chain line in FIG. 3. And, when the pivoting arm 54 is pivoted by a prescribed angle, the first limiting switch 70 senses the cut-out 66*a* of the dog member 66 to produce a start signal for starting the winding motor 32, following which the winding motor 32 is started to cause the take-up reel 22 to rotate to take up the masking tape 14 thereon. When the prescribed portion of the masking tape 14 is wound on the take-up reel 22, the pivoting arm 54 is pivoted counterclockwise (FIG. 3) by a prescribed angle, and the second limit switch 72 senses the cut-out 68*a* of the dog member 68 to produce a stop signal for stopping the winding motor 32. Thus, the motor 32 is stopped, and a prescribed length of the masking tape 14 is wound up onto the take-up reel 22.

After the prescribed length of the masking tape 14 has been wound up on the take-up reel 22, another workpiece is disposed in position, and the above procedures are repeated.

In the foregoing operation, if the masking tape 14 is almost wound from the feed reel 20 on the take-up reel 22, the tape detecting device 160 senses the fact to raise an alarm or to produce a stop signal to send to the control device 52 to stop all the devices. Specifically, when the masking tape 14 wound on the feed reel 20 reduces, the pivoting arm 162 is caused to pivot counterclockwise (FIG. 3) under the influence of the spring 166, and when the pivoting arm 162 is pivoted to a position as shown in a two-dot and chain line in FIG. 3, the limit switch 169 senses the cut-out 168*a* of the dog member 168 to produce the above signal or the like.

In the sandblasting apparatus as mentioned above, inasmuch as the urging rod 130 is urged toward the workpiece W through the two springs 154 and 156, an appropriate urging force can be obtained. Accordingly, the workpiece W is prevented from being subjected to breakage due to an excessive urging force, and besides the masking tape 14 is urged on the workpiece W to cover the second surfaces completely, thereby preventing the abrasive grains from impinging against the first surfaces to be processed.

Further, in the above apparatus, the tension of the masking tape 14 is always maintained constantly by the tension control mechanisms 24 and 26 during the operation, and therefore the masking tape 14 is hardly subjected to cutting and sagging. It would be noted that the biasing force of the spring 86, 110 may be suitably modified depending upon the workpiece. Specifically, if the workpiece has a deep groove, recess or the like formed in the surface thereof, the spring may be selected so that the masking tape is successfully brought into contact with the surface of the workpiece.

Further, since the winding motor 32 of the take-up reel 22 is easily controlled in response to the pivotal movement of the arcuate arm 54, the control system of the winding mechanism is very simple. In addition, inasmuch as a frictional resistance is exerted on the shaft 28 of the feed reel 20, the inertia of the feed reel 20 is prevented, and therefore the slacking of the masking tape 14 can be prevented. Further, since the urging roller 94 is provided for preventing the masking tape 14 from slacking, a resistance exerted for winding the masking tape can be always maintained uniformly despite the remaining amount of the masking tape.

In addition, since the moving speed of the piston rod 134 of the pneumatic cylinder 132 is adjusted variously by the speed control valve of the pneumatic circuit, the urging rod 130 can be urged toward the workpiece at an optimum speed. Further, the height of the bracket 136 for mounting the pneumatic cylinder 132 can be adjusted by the screws 140 and the elongated apertures 138 formed in the bracket 136, so that the height of the urging rod 130 can be adjusted optimally depending upon the size of the workpiece W.

Figure 9:
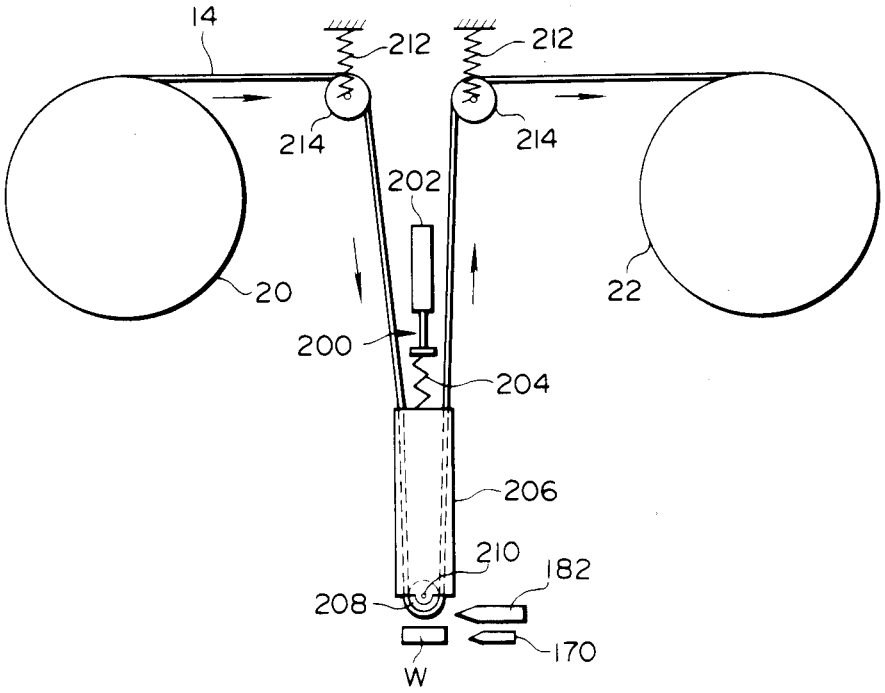
FIG. 9 is a schematic front elevational view of a modified sandblasting apparatus in accordance with the present invention.
Figure 10:
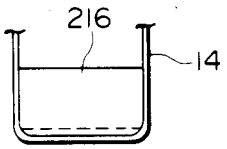
FIG. 10 is a schematic view showing a modified urging member mounted on the apparatus of FIG. 9.
Figure 11:
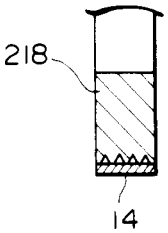
FIG. 11 is a sectional view showing a further modified urging member mounted on the apparatus of FIG. 9.

FIG. 9 shows a modified sandblasting apparatus which includes an urging device 200 consisting of a pneumatic cylinder 202, a spring 204 fixedly secured at its one end to a piston rod of the cylinder 202, a tubular guide 206 having one end to which the other end of the spring 204 is fixedly secured, and an urging member in the form of a roller 208 mounted at the other end of the guide 206 through a shaft 210, the masking tape 14 passing through the guide 206. The apparatus further includes simple guide and tension control mechanisms each consisting of a spring 212 and a guide roller 214. FIG. 10 shows a modified urging member 216 which has a flat end face to be brought into contact with the masking tape 14, those opposite corner edges of the end face being rounded off to thereby facilitate traveling of the masking tape 14. FIG. 9 shows a further modified urging member 218 which has a milled or notched peripheral surface for reducing friction exerted between the urging member and the masking tape 14.

In the foregoing, the urging member may be made of soft and resilient material such as sponge and rubber. The contact surface of the urging member may be formed so as to be fitted on the second surfaces of the workpiece. In these cases, the masking tape may be comprised of a very thin film. Further, although the abrasive grains are blown together with the compressive air, they may be blown together with other gas or liquid.

Obviously many modifications and variations of the present invention are possible in the light of the above teachings. It is therefore to be understood that within the scope of the appended claims, the invention may be practiced otherwise than as specifically described.

What is claimed is:

1. An apparatus for masking a surface portion of an object comprising:

a masking tape;

intermittent tape traveling means operable to cause said masking tape to travel by a prescribed length to index a portion of said masking tape in the vicinity of said object intermittently, said intermittent tape traveling means comprising a base, a feed reel rotatably mounted on said base and having said masking tape wound therearound, a take-up reel rotatably mounted on said base in spaced relation to said feed reel, and winding means for winding said masking tape wound around said feed reel on said take-up reel; and urging means operable to urge said portion of said masking tape into contact with said surface portion of said object to cover the same, said urging means including an urging rod having an urging member at one end thereof and disposed between said feed and take-up reels, and a drive cylinder including a piston rod having a foremost end and operably connected to the other end of said urging rod for moving said urging rod axially thereof to cause said urging member to urge said portion of said masking tape onto said portion of said object, said urging rod having a bore formed therein so as to extend axially thereof and opening to an end face at said other end and a flange formed at said other end, said foremost end of said output shaft of said actuator being housed in said bore of said urging rod coaxially therewith for sliding movement longitudinally of said urging rod, a first spring disposed in said bore so as to act between said piston rod and said urging rod to urge said urging rod in a direction toward said object, stopper means fixedly secured on said base so as to be disposed intermediate said ends of said urging rod, and a second spring disposed around said urging rod so as to act between said flange portion of said urging rod and said stopper means to urge said urging rod in a direction away from said object.

2. A sandblasting apparatus for processing a workpiece by causing abrasive grains to impinge against the workpiece, said workpiece having a first surface to be processed and a second surface not to be processed, comprising:

masking means including a masking tape, intermittent tape traveling means operable to cause said masking tape to travel by a prescribed length to index a portion of said masking tape in the vicinity of said workpiece intermittently, and urging means operable to urge said portion of said masking tape into contact with said second surface of said workpiece to cover the same, wherein said urging means includes an urging member disposed adjacent to said workpiece, and an actuator operably connected to said urging member for moving said urging member toward said workpiece to cause said urging member to urge said portion of said masking tape onto said second surface of said workpiece; and abrasive grain blowing means for blowing the abrasive grains against said workpiece to process said first surface of said workpiece.

3. A sandblasting apparatus according to claim 2, in which said urging member is comprised of a roller.

4. A sandblasting apparatus according to claim 2, in which said intermittent tape traveling means comprises a base, a feed reel rotatably mounted on said base and having said masking tape wound therearound, a take-up reel rotatably mounted on said base in spaced relation to said feed reel, and winding means for winding said masking tape wound around said feed reel on said take-up reel.

5. A sandblasting apparatus according to claim 4, in which said winding means comprises rotating means mounted on said base for rotating said take-up reel about an axis thereof, pinch and pressing rollers mounted on said base for cooperating with each other to wind said masking tape from said feed reel, an arcuate arm mounted on said base for pivotal movement about one end thereof, a guide roller mounted on the other end of said arcuate arm for guiding said masking tape, a spring having one end connected to said arm and the other end connected to said base for urging said arm to pivot in a prescribed direction, first and second dog members disposed on said one end of said arm, respectively, a first limit means disposed adjacent to said first dog member for sensing said first dog member to produce a signal for starting said winding means when said arm is pivoted to a first position, and a second limit switch disposed adjacent to said second dog member for sensing said second dog member to produce a stop signal for stopping said winding means when said arm is pivoted to a second position.

6. A sandblasting apparatus according to claim 4, in which said urging means includes an urging rod having said urging member at one end thereof and disposed between said feed and take-up reels, wherein said actuator is operably connected to the other end of said urging rod for moving said urging rod axially thereof to cause said urging member to urge said portion of said masking tape onto said second surface of said workpiece.

7. A sandblasting apparatus according to claim 6, in which said urging member includes a flat end face to be brought into contact with said masking tape, those opposite corner edges of said end face spaced longitudinally of said masking tape being rounded off.

8. A sandblasting apparatus according to claim 6, in which said actuator is comprised of a drive cylinder including a piston rod having a foremost end, said urging rod having a bore formed therein so as to extend axially thereof and opening to an end face at said other end and a flange portion formed at said other end, said foremost end of said piston rod of said cylinder being housed in said bore of said urging rod coaxially therewith for sliding movement longitudinally of said urging rod, a first spring disposed in said bore so as to act between said piston rod and said urging rod to urge said urging rod longitudinally of said urging rod toward said workpiece, stopper means fixedly secured on said base and disposed intermediate said ends of said urging rod, and a second spring disposed around said urging rod so as to act between said flange portion of said urging rod and said stopper means to urge said urging rod longitudinally of the urging rod away from said workpiece.

9. A sandblasting apparatus according to claim 8, in which said urging means further includes means for preventing said urging rod from rotating circumferentially thereof.

10. A sandblasting apparatus according to claim 8, further including a bracket mounted on said base slidably longitudinally of the urging rod and fastening means for fixedly securing said bracket to said base, said actuator being mounted on said bracket.

11. A sandblasting apparatus according to claim 4, further comprising tape detecting means for detecting a remaining amount of said masking tape wound on said feed reel.

12. A sandblasting apparatus according to claim 11, in which said tape detecting means comprises an arm mounted on said base for pivotal movement about one end thereof, a roller mounted on the other end of said arm, a spring having one end connected to said bar and the other end connected to said base for urging the other end of said arm radially inwardly of said feed reel to bring said roller into contact with said masking tape wound on said feed reel, a dog member disposed on said one end of said bar, and limit means disposed adjacent to said dog member for sensing said dog member when said arm is pivoted by a prescribed angle.

13. A sandblasting apparatus according to claim 4, further comprising means for regulating tension of said masking tape.

14. A sandblasting apparatus according to claim 2, further comprising cleaning means disposed adjacent to said abrasive grain blowing means for blowing a compressive air against said workpiece to remove said abrasive grains adhered thereto.

15. A method of sandblasting a workpiece having a first surface to be processed and a second surface not to be processed, comprising the steps of:

(a) providing a sandblasting apparatus comprising masking means including a masking tape, intermittent tape traveling means operable to cause said masking tape to travel by a prescribed length to index a portion of said masking tape in the vicinity of said workpiece intermittently, and urging means including an urging member movable by an actuator to urge said portion of said masking tape into contact with said second surface of said workpiece to cover the same; and abrasive grain blowing means for blowing the abrasive grains against said workpiece to process said first surface of said workpiece;

(b) operating said actuator so as to move said urging member in such a manner as to bring said portion of said masking tape into contact with said second surface of said workpiece to cover the same;

(c) subsequently operating said abrasive grain blowing means to blow said abrasive grains against said workpiece to process said first surface of said workpiece;

(d) subsequently stopping said abrasive grain blowing means to cease blowing said abrasive grains against said workpiece; and (e) subsequently operating said masking means to release said masking tape from said workpiece.

16. A sandblasting method according to claim 15, further comprising a step of blowing a compressive air against said workpiece to remove said abrasive grains adhered thereto prior to said step (e).

* * * * *